US009433254B2

(12) United States Patent
Lee

(10) Patent No.: US 9,433,254 B2
(45) Date of Patent: Sep. 6, 2016

(54) FOOTWORK ACTIVITY INSTRUCTION AND EVALUATION APPARATUS AND SYSTEM

(71) Applicant: Step-Right LLC, Fairfield, CT (US)

(72) Inventor: Elliot Goodman Lee, Westport, CT (US)

(73) Assignee: Step-Right LLC, Fairfield, CT (US)

( * ) Notice: Subject to any disclaimer, the term of this patent is extended or adjusted under 35 U.S.C. 154(b) by 379 days.

(21) Appl. No.: 14/226,303

(22) Filed: Mar. 26, 2014

(65) Prior Publication Data

US 2015/0272264 A1 Oct. 1, 2015

(51) Int. Cl.

| | |
|---|---|
| ***G03B 15/02*** | (2006.01) |
| ***A43B 3/00*** | (2006.01) |
| ***A43B 3/16*** | (2006.01) |
| ***A43B 5/12*** | (2006.01) |
| ***A43B 13/22*** | (2006.01) |

(52) U.S. Cl.

CPC ..... *A43B 3/0021* (2013.01); *A43B 3/001* (2013.01); *A43B 3/16* (2013.01); *A43B 5/12* (2013.01); *A43B 13/223* (2013.01)

(58) Field of Classification Search

CPC ..... A43B 3/001; A43B 3/0021; A43B 3/16; A43B 5/12; A43B 13/223

USPC ..... 362/103

See application file for complete search history.

(56) References Cited

U.S. PATENT DOCUMENTS

| | | | | |
|---|---|---|---|---|
| 6,776,845 | B2 * | 8/2004 | Minami | H01L 21/67253 118/321 |
| 2006/0064037 | A1 * | 3/2006 | Shalon | A61B 5/0006 600/586 |
| 2008/0318679 | A1 * | 12/2008 | Tran | A43B 3/0005 463/39 |
| 2012/0172677 | A1 * | 7/2012 | Logan | A61B 5/082 600/301 |
| 2013/0217332 | A1 * | 8/2013 | Altman | H04H 60/90 455/41.2 |
| 2014/0070957 | A1 * | 3/2014 | Longinotti-Buitoni | G06F 1/163 340/870.01 |

* cited by examiner

*Primary Examiner* — Ali Alavi

(74) *Attorney, Agent, or Firm* — Perman & Green, LLP

(57) ABSTRACT

An intelligent footwork device that provides a user with visual instruction and direction of each footwork activity. The visual instruction is provided by directional lights embedded into the footwork device. The target footwork activity is compared to the actual footwork activity and an evaluation score is provided to the user.

38 Claims, 6 Drawing Sheets

FOOTWORK ACTIVITY INSTRUCTION AND EVALUATION APPARATUS AND SYSTEM

BACKGROUND

1. Field

The exemplary embodiments generally relate to an apparatus and system for instructing and evaluating footwork routines and, more particularly, to footwork device having an array of lights for providing visual instructions for each step of the footwork routine.

2. Brief Description of Related Developments

Shoes with integrated battery power, lights and speakers have become increasingly popular, especially in the areas of running, walking, aerobics and dance. For example, lighted shoes have entertained children while they walk, run or dance for some time now. This type of shoe typically lights up when the child strikes her foot against the ground or moves the shoe in a rapid motion. There are generally electrical switches integrated into the shoe that makes a circuit when the shoe is accelerated or moved rapidly. Once the circuit is made, battery power is typically applied directly to the lights to illuminate the shoe. Other children's shoes have also integrated speakers that make various sounds as the shoe strikes the ground or moved rapidly using battery power, switches and electrical circuits similar to those in the lighted shoes.

More recently, shoes have become increasingly intelligent where electronic sensors, micro controllers, speakers and memory are now integrated directly into the shoe. For example, there is now a dance shoe that provides an audio output and a vibratory stimulus to help guide the user in their footwork activities. The user may listen to the audio output and feel the vibratory stimuli in their feet to help guide them in the proper footwork direction. In another example, there is now a running shoe that monitors the users foot speed, ground acceleration and step count and stores the information in a memory that is integrated into the shoe. This information may later be retrieved by a computer capable of analyzing and reporting the footwork activities. In yet another example, there is now a dancing shoe system that monitors a target foot movement against an actual foot movement and provides a score to the user of their actual results. The system typically includes a floor mat that has an array of sensors integrated into the mat and a dance shoe with an integrated sensor. The dance shoe sensor communicates with the mat sensors and determines the position of the user's actual foot strikes. The actual foot strikes are then compared to the target foot strikes and a score is determined and reported to the user.

It would be advantageous to have a footwork device that provides visual instructions to the user and provides direct feedback as to the accuracy of the footwork activities movement.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

Figure 1:
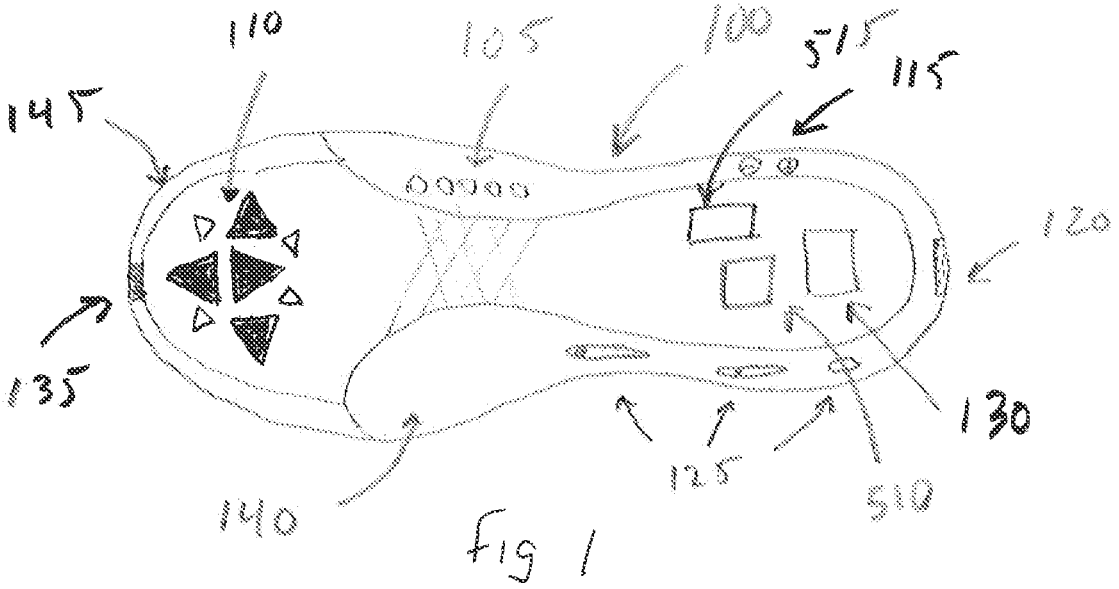
FIG. 1 shows a schematic illustration of a footwork device in accordance with aspects of the disclosed embodiment.
Figure 1A:
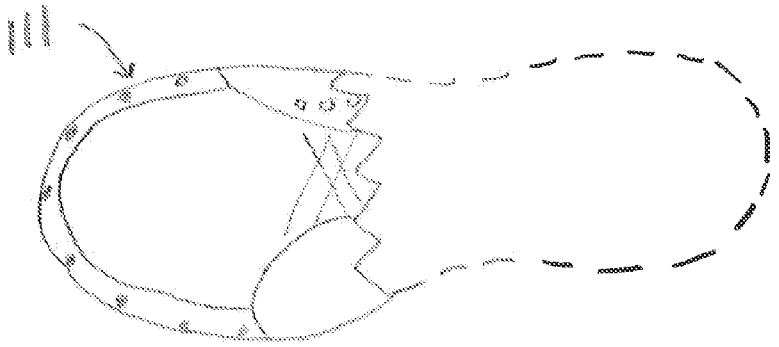
FIG. 1*a* shows a schematic illustration of a footwork device in accordance with aspects of another disclosed embodiment.

FIGS. 1 and 1*a* show a schematic illustration of a footwork device in accordance with aspects of the disclosed embodiment. The exemplary footwork device provides visual instructions to a user by illuminating the directional lights 110. The exemplary footwork device 100 may include one or more directional lights 110, motion sensors 510, score indicator 105, speaker 120, volume control 115, instruction and evaluation module 130, selector and display controls 125, upper shoe member 140, sole shoe member 145 and a magnet 135. Although the aspects of the disclosed embodiment will be described with reference to the drawings, it should be understood that the aspects of the disclosed embodiment can be embodied in many forms. In addition, any suitable size, shape or type of elements or materials could be used.

In one aspect, the directional lights 110 may be embedded into the top of the upper shoe member 140. The directional lights 110 might be in the shape of an arrow or any other suitable shape indicating direction. The directional lights 110 may be of any color and one or more lights may be illuminated at one time. In one aspect, there may be four directional lights 110 pointing east, west, south and north. In other aspects, there may be diagonal directional lights 110 indicating directional moves at 45 degrees to east, west, south and north. In other aspects, the directional lights 110 may be embedded into the front of the upper shoe member 140. The lights may be LEDs and positioned at any distance and interval around the front of the upper shoe member 140. The illumination sequence of the directional lights 110 is controlled by the instruction and evaluation module 130, which will be discussed in further detail below.

In one aspect, the upper member 140 and sole member 145 may be connected to each other by any standard means. The sole member 145 may be made of a non-slip rubberized material or any other suitable non-slip material. The supper member 140 may be made out of any standard dance shoe fabric capable of supporting the directional lights 110. The combined upper member 140 and sole member 145 may have laces to tighten the supper member 140 or may be of a slip on type.

In one aspect, the at least one motion sensor 510 may be embedded at any location in the sole member 145 or the supper member 140. The at least one motion sensor 510 determines the direction of the actual foot movement and provides this information to the instruction and evaluation module 130 to be used by the evaluation routine, which will be discussed in detail below. The motion sensor 510 may be an accelerometer or any other suitable device capable of determining the direction of the footwork device.

In one aspect, a speaker 120 may be embedded into the back of the supper member 140. In other aspects the speaker 120 may be embedded at any location of the upper and sole member where the audio output may be heard by the user. The speaker 120 may have a volume control 115 that enables the user to increase the level of the audio output of the speaker 120. The audio output may be directly controlled by the volume control 115 or automatically controlled by the instruction and evaluation module 130. The speaker 120 and the volume control 115 are electrically connected to the instruction and evaluation module 130. The user may manually adjust the volume control 115, which is monitored by the instruction and evaluation module 130 and the instruction and evaluation module 130 may set the level of the audio output of the speaker 120. The speaker 120 may be waterproof or suitable for any harsh conditions such as heat, cold, rain and snow.

In one aspect, a receiver 520 may be embedded into the sole member 145. In other aspects the receiver may be embedded at any location of the upper and sole member where the receiver is capable of receiving a user communication. The receiver may receive communications from a remote unit 315 or any other suitable device. In another aspect, the receiver 520 may be a transmitter and receiver allowing two way communications to/from the remote unit 315. The receiver 520 is electrically connected to the instruction and evaluation module 130 and provides user input. The user communication input may be new instruction routines or software upgrades. The instruction routines may comprise an audio output file and instructions for illuminating the array of lights 110. The instruction routine may comprise only instructions for illuminating the direction lights or only an audio file.

In one aspect, selector input devices 125 may be embedded into the side of the supper member 140. In other aspects the selector input devices may be embedded at any location of the upper and sole member where the selector input devices are capable of allowing the user to set input information. The selector input devices may be slider or rotary knobs and may include LEDs or LDC display or any other suitable selection and display device. The selector input device may be a dance selection, a pace selection and a male/female selection. The dance selection device allows the user to scroll through and select the instruction routines currently available in the instruction and evaluation module 130. In other aspects, the dance selection may be automatically set by the instruction and evaluation module 130 based on a predetermined level of the user's abilities, randomly or any other suitable criteria. The pace selection device allows the user to set the pace of the instruction routine from slow to fast. The pace may be incremental based on level of the user's abilities or continuously by adjusting the selection device. The male/female selector device allows the user to configure the footwork device for either a male instruction routine or a female instruction routine. Instruction routines may be configured for male, female or unisex users. An instruction routine configured for male may illuminate the directional lights 110 in a different sequence than the instruction routine configured for a female while dancing to the same audio output. An instruction routine for unisex users may illuminate the directional lights 110 in the same sequence for both male and female users.

In one aspect, a score indicator 105 may be embedded into the side of the supper member 140. In other aspects the score indicator 105 may be embedded at any location of the upper and sole member where the user may view the foot activity scores. The score indicator 105 is electrically connected to the instruction and evaluation module 130. The instruction and evaluation module 130 may compare the instruction routine to the evaluation routine and may determine a user score and set the score indicator 105. The score indicator 105 may be LED or LCD display or any other suitable display device.

In one aspect, the instruction and evaluation module 130 may be embedded into the sole member 145. In other aspects the instruction and evaluation module 130 may be embedded at any location of the upper and sole member where the instruction and evaluation module 130 is capable of being electrically connected to the array of lights 110, the at least one motion sensor 510, the speaker 120, the receiver 520, the selector input devices 125, the score indicator 105 and a power supply 515. The instruction and evaluation module 130 may be a processor, memory and executable software code and powered by a battery 515. The battery 515 may be non-rechargeable or rechargeable and may be of any suitable battery type. A non-rechargeable battery may be removed and replaced from/to the footwork device by any suitable means. A rechargeable battery may be removed and replaced from/to the footwork device by any suitable means or may be recharged while remaining in the footwork apparatus by any suitable power source. The instruction and evaluation module 130 provides intelligence to the footwork apparatus. The instruction and evaluation module 130 is preloaded with a number of instruction routines and evaluation routines. New routines may be transmitted to the instruction and evaluation module 130 through the receiver 520 by any suitable means. In one aspect, the user may place the footwork apparatus on their feet and select an instruction routine, select a pace, select a male/female setting and set the audio output level. The directional lights 110 may indicate that the footwork apparatus is about to begin operating. The user may also hear the audio output from the speaker 120 count down indicating that the footwork device is about to begin. The audio output from the speaker 120 may start to play the selected instruction routine and the directional lights 110 begin to illuminate providing directional instruction to the user. The user may view the directional arrows and begin the footwork activity. With each footwork motion the motion sensor 510 determines the direction and rate of the footwork device. The instruction and evaluation module 130 stores each footwork motion to be used by the evaluation routine. The evaluation routine may be constantly comparing the footwork motion to the instruction routine and user score may be determined. The instruction and evaluation module 130 controls the score indicator 105 and the score may be presented real time or after the user has completed the instruction routine. The instruction routine may be for any type of type of dance, for example the Waltz, Swing, Salsa, Cha-cha and Free Style or any type of footwork game such as a hopscotch, hacky sack and balance walking. The above is only a small representation of the possible instruction routines; there may be any suitable dance, game or footwork activity instruction and evaluation routines.

Figure 2:
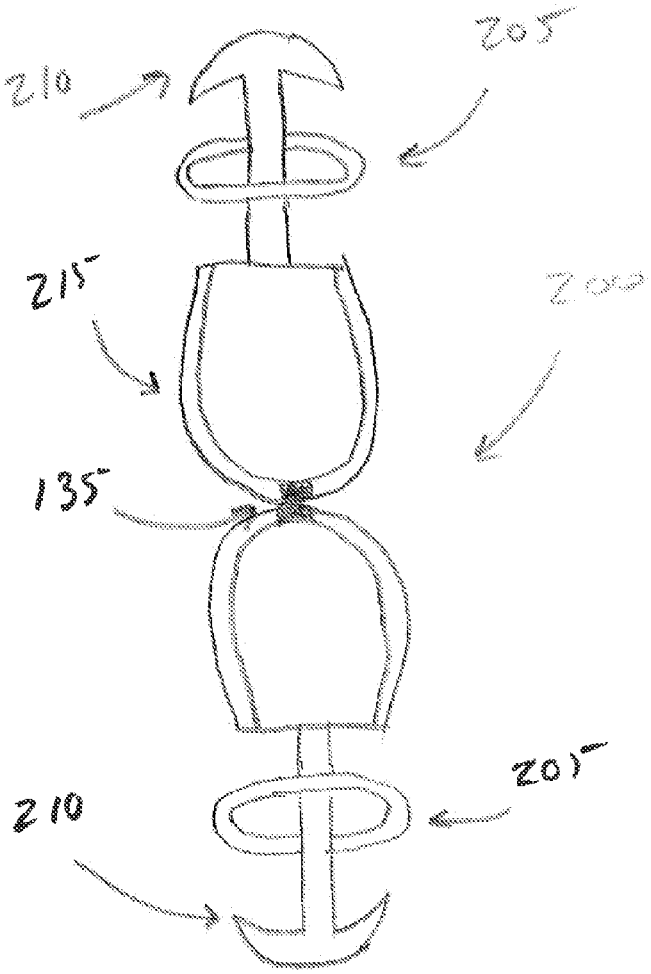
FIG. 2 shows a schematic illustration of another footwork device in accordance with aspects of the disclosed embodiment.

Referring to FIG. 2 each component of the footwork device 200 may be substantially similar to the footwork device 100. In one aspect, the magnets 135 may be may be embedded into the sole member 145. In other aspects the magnets 135 may be embedded at any location of the upper and sole member where the magnets 135 are capable of attractive force with a second footwork device. In one aspect, there may be an extendable heel device 210 that may be adjusted to fit the foot size of the user. The heel device 210 may have a non-slip material on the bottom side of the heel. In another aspect, there may be a strap 205 that may secure the footwork device to the user. In one aspect, two users may place the footwork device on their feet and face each other. The magnets 135 may attract to each other and the footwork devices may connect to each other. As the two users perform their footwork activities, the magnets 135 may stay connected or become separated. When the two users correctly perform the instruction routine the magnets 135 remain connected. When the two users incorrectly perform the instruction routine the magnets 135 become separated. The magnets 135 may help the two users correctly perform the instruction routines.

Figure 3:
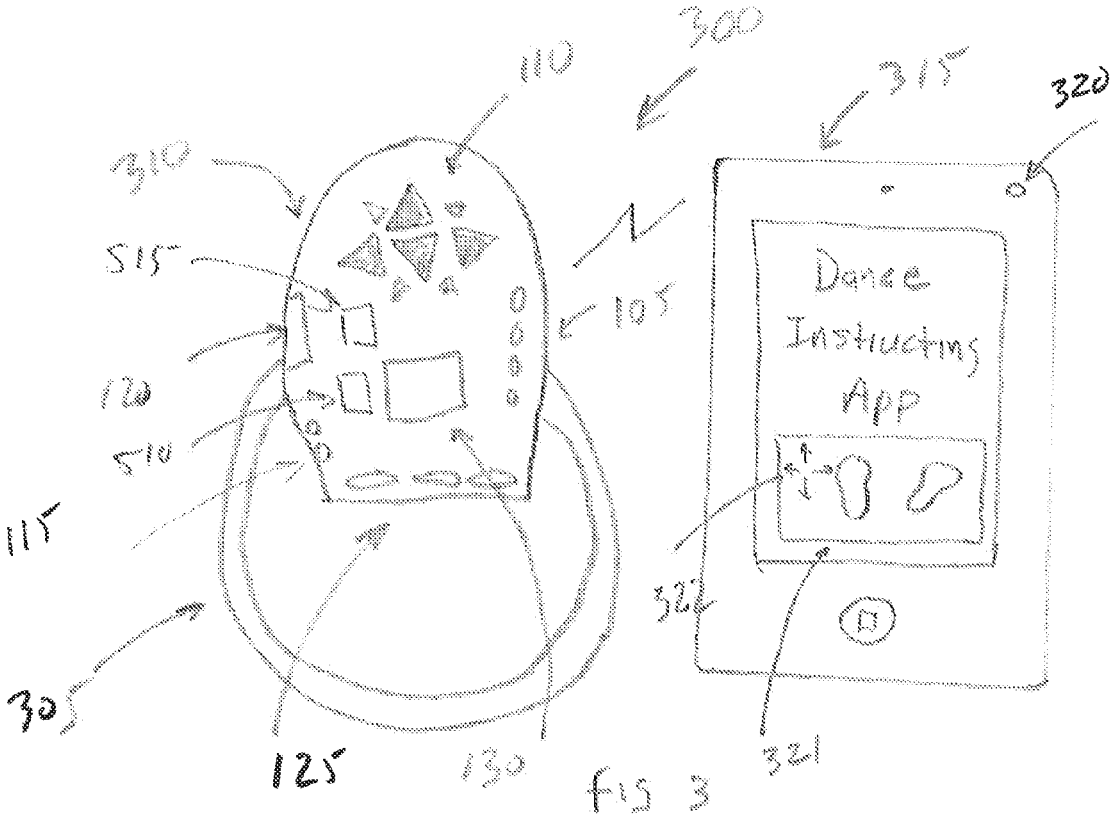
FIG. 3 shows a schematic illustration of yet another footwork device and footwork system in accordance with aspects of the disclosed embodiment.

Referring to FIG. 3 each component of the footwork device 300 may be substantially similar to the footwork device 100. In one aspect, the footwork device 300 may slip over or attach directly to a user's dance shoe, sneaker or any other suitable shoe. The strap 305 may secure the footwork device to the user's shoe by looping the strap 305 under the sole of the shoe, around the user's ankle or any other suitable means. In one aspect, the remote unit 315 may transmit instruction routines to the instruction and evaluation module 130 through the receiver 520. In one aspect, the remote unit 315 may have a camera 320 that is capable of recording the user's footwork activity. The user may perform the same instruction routines as discussed earlier while directing the camera at the user's feet. The camera may monitor the foot activities and perform the evaluation routine on the remote unit 315. A score may be indicated on the remote unit 315 or on the footwork device score indicator 105. In another aspect, the user may perform the instruction routine by following the arrows 322 on the remote device. The footwork device 300 may operate substantially similar to the footwork device 100 without the use of remote unit 315.

Figure 4:
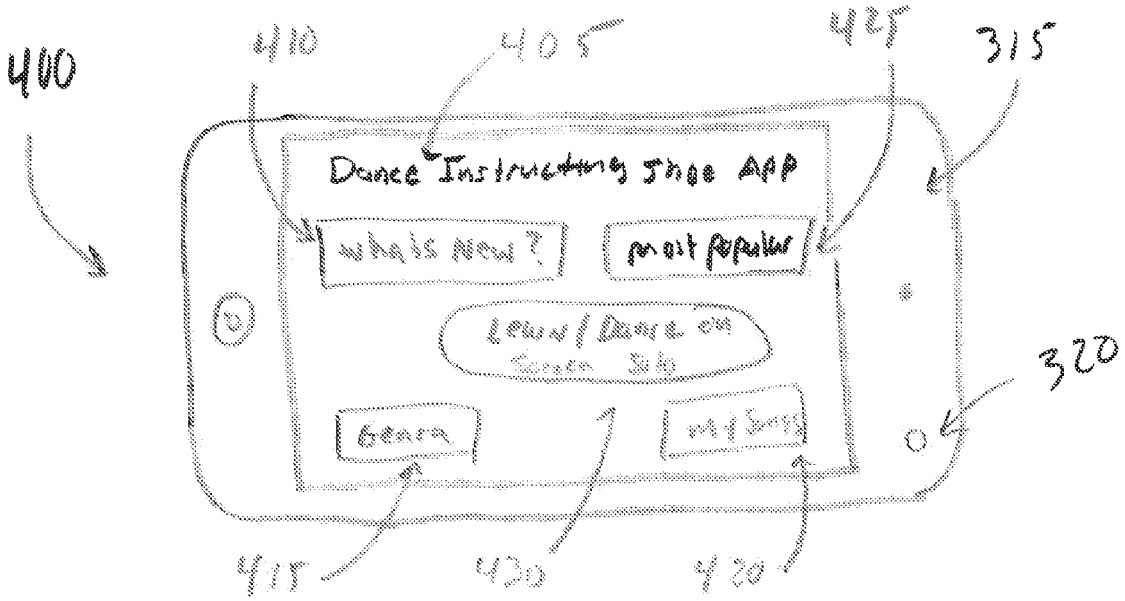
FIG. 4 shows a schematic illustration of a footwork system user interface in accordance with aspects of the disclosed embodiment.
Figure 4A:
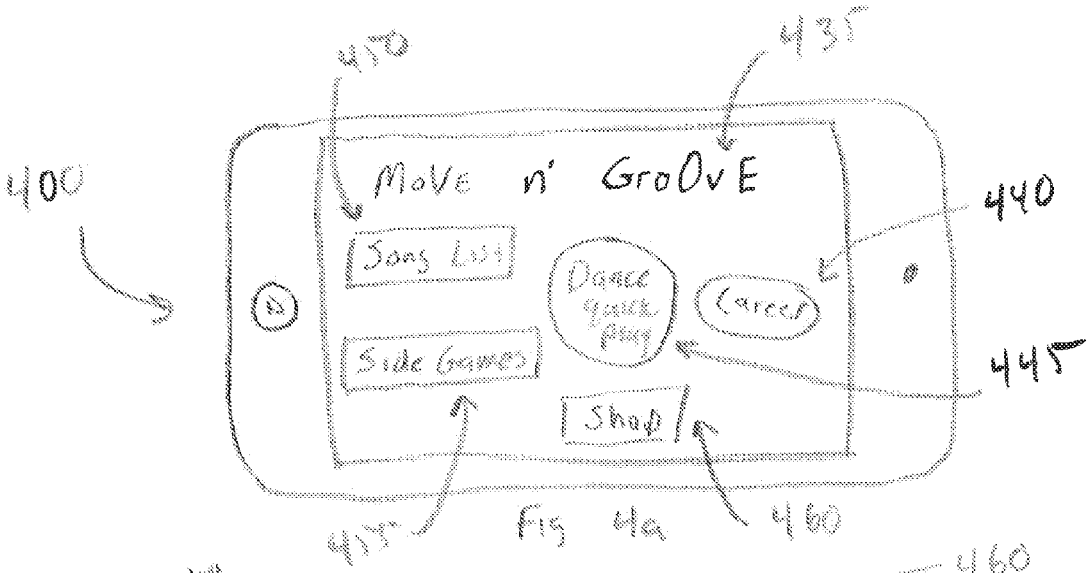
FIG. 4*a* shows a schematic illustration of another footwork system user interface in accordance with aspects of the disclosed embodiment.
Figure 4B:
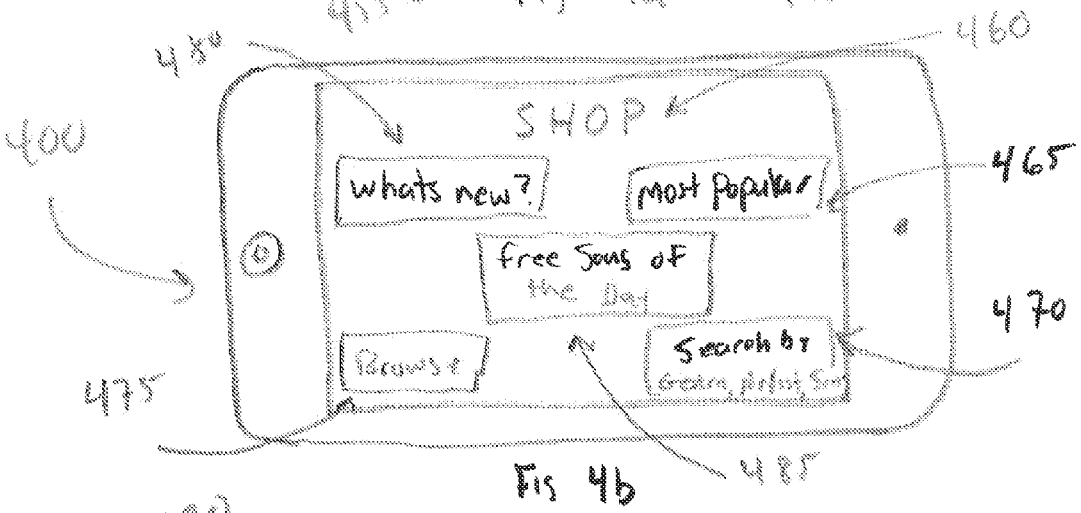
FIG. 4*b* shows a schematic illustration of yet another footwork system user interface in accordance with aspects of the disclosed embodiment.
Figure 4C:
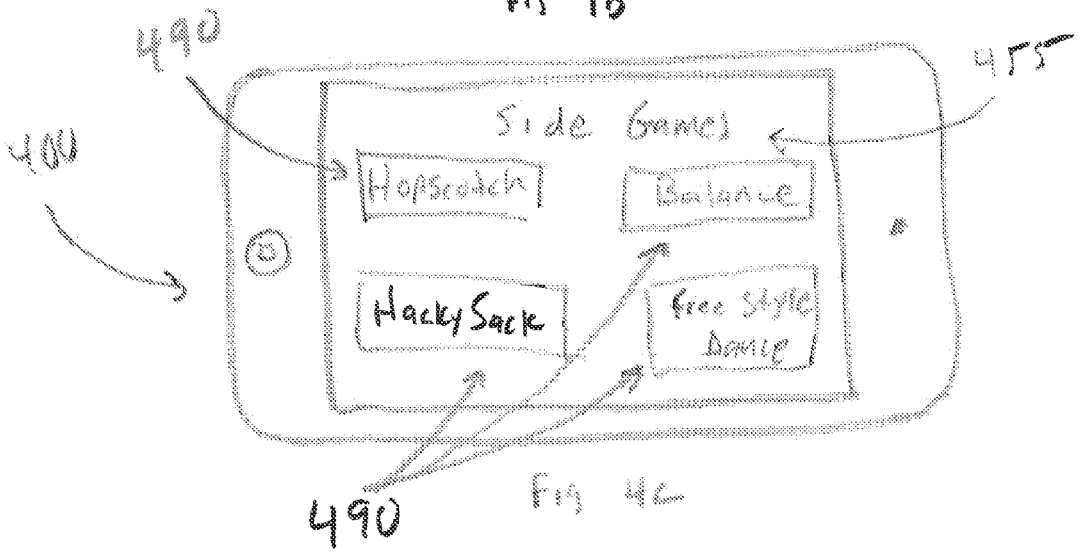
FIG. 4*c* shows a schematic illustration of yet another footwork system user interface in accordance with aspects of the disclosed embodiment.
Figure 5:
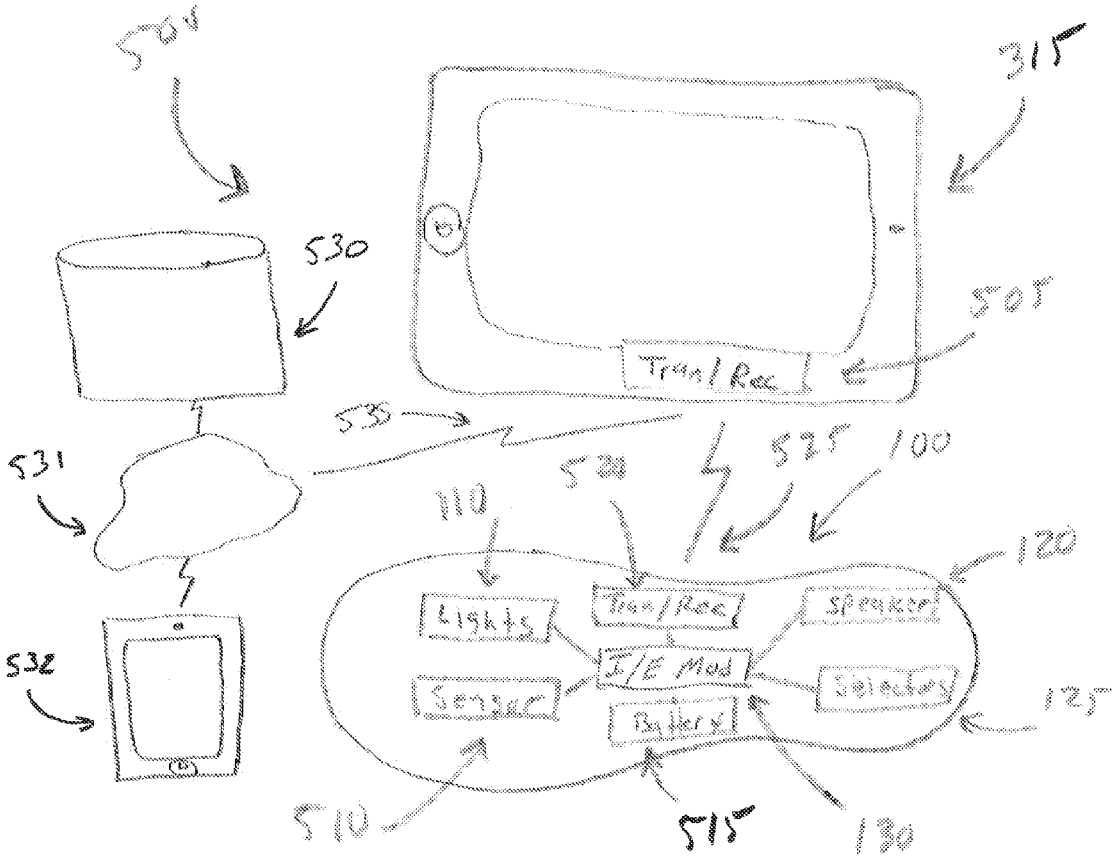
FIG. 5 shows a block diagram of footwork device circuitry and footwork system in accordance with aspects of the disclosed embodiment.

Referring to FIG. 4 each component of the remote device in 400 may be substantially similar to the remote device in 300. In one aspect the remote device 315 may have a Dance Instructing Shoe Application that may be initially pre-loaded with a number of instruction routines. The Dance Instructing Shoe Application 405 may have a what's new 410, most popular 425, genre 415, my songs 420 and learn/dance on screen solo 430 sub applications. The what's new sub-application may provide the user with a listing of all the new instruction routines available within the Dance Instructing Shoe Application. The most popular sub-application may provide the user with a list of the most popular instruction routines. The genre sub-application may provide the user with a list of available instruction routines based on a selected genre. The my songs sub-application may provide a list of all the instruction routines that have been performed by the user. The learn/dance on screen solo sub-application may allow the user to perform an instruction routine by following the directional moves on the remote unit dance screen window 321. The speaker 120 on the footwork device may be disabled and the audio output may come from the remote device. The speaker 120 in the remote device is any suitable speaker 120. The remote device may be an Apple iPhone, Samsung Android or any other suitable PDA or smart phone. In one aspect, the Dance Instructing Shoe Application may be automatically updated with new instruction routines and the user may periodically check for new content. In another aspect, the user may request that the Dance Instructing Shoe Application be updated with all currently available instruction routines.

Referring to FIGS. 4*a*, 4*b*, 4*c* and 5 each component of the remote device in 400 may be substantially similar to the remote device in 300. In one aspect, the remote device 400 may have a move n' groove 435 application. The move n' groove application may have a song list 450, side games 455, shop 460, career 440 and dance quick play 445 sub-applications. The song list sub-application may list all the instruction routines currently available on the remote device. In another aspect, the song list sub-application may list all the instruction routines currently available on the remote database 530. The instruction routines currently available on the remote database 530 may be transmitted to the remote unit 315. The user may be required to pay for each instruction routine that is transmitted to the remote unit 315. In another aspect, the user may not be required to pay for each instruction routine that is transmitted to the remote unit 315. The remote database 530 may automatically update all remote units 315 on a periodic basis. The side games 455 sub-application may list all the side games 455 currently available on the remote unit 315 or on the remote database 530. The transmit and payment methods for the side games 455 is substantially similar to those described for the song list sub-application. In one aspect, the career 440 sub-application may list all the instruction routines and evaluation routine scores for all the instruction routines performed by the user. The career 440 results may be stored on the remote database 530 or the remote unit 315. In one aspect, the career 440 results may be compared to other users connected to the remote database 530. The shop sub-application may list all new instruction routines, may browse all current and new instruction routines, may search for instruction routines by genre, artist or song, may list the most popular instruction routines and may provide the user with a free song of the day 485. The instruction routines may reside on the remote unit 315 or remote database 530. In one aspect, the dance quick play 445 sub-application may randomly select an instruction routine to be transmitted to the footwork device. In one aspect, the remote unit 315 may browse a list of currently available instruction routines on the remote database 530. The remote unit 315 may request the remote database 530 to transmit the selected instruction routine. The remote database 530 may transmit the selected routine to the remote unit 315. The remote unit 315 may transmit the selected instruction routine to the footwork device through the receiver 520. The footwork device may operate alone or in combination with the remote unit 315 as described earlier. In one aspect, multiple remote users 532 may have access to the remote database 530. The multiple users may communicate via a social media site to organize a competition between the users. The social media sites may be FaceBook, Instagram, google talk, or any other suitable social media site. The multiple users may perform the instruction routine and the evaluation routine results may be transmitted to the remote database 530 for comparison. The remote database 530 may communicate to the remote units 315 through the internet 531, cloud 531 or any other suitable communications media.

In accordance with one or more aspects of the disclosed embodiment, a footwork apparatus includes an upper member and a sole member connected to the upper member, an array of lights for instructing the direction of the footwork activity, at least one motion sensor for determining the direction of the footwork activity, a speaker for providing an audio output, a receiver for receiving a user communication input, at least one selector for providing a user selection input, an instruction and evaluation module comprising a processor, memory and execution code configured to communicate with the array of lights, the at least one motion sensor, the speaker, the receiver and the at least one selector, and a power source for powering the instruction and evaluation module 130, the array of lights, the at least one sensor, the speaker, the receiver and the at least one selector.

In accordance with one or more aspects of the disclosed embodiment, a footwork apparatus includes a transmitter for transmitting an instruction and evaluation module communication output.

In accordance with one or more aspects of the disclosed embodiment, the array of lights are arrow shaped lights embedded in the top of upper member.

In accordance with one or more aspects of the disclosed embodiment, the array of lights are LED lights embedded in the side of the upper member.

In accordance with one or more aspects of the disclosed embodiment, a magnet is embedded in the front of the upper member for connecting the article of footwork to a second article of footwork.

In accordance with one or more aspects of the disclosed embodiment, the instruction and evaluation module is embedded in the sole member.

In accordance with one or more aspects of the disclosed embodiment, the instruction and evaluation module is embedded in the upper member.

In accordance with one or more aspects of the disclosed embodiment, the instruction and evaluation module includes an instruction routine and an evaluation routine.

In accordance with one or more aspects of the disclosed embodiment, a footwork apparatus includes a score indicator indicating a result of the evaluation routine.

In accordance with one or more aspects of the disclosed embodiment, the score indicator includes a set of lights or a liquid crystal display.

In accordance with one or more aspects of the disclosed embodiment, a footwork apparatus includes a volume control for adjusting the intensity of the audio output.

In accordance with one or more aspects of the disclosed embodiment, a footwork apparatus includes a heel support member connected to the sole member.

In accordance with one or more aspects of the disclosed embodiment, a footwork apparatus includes a strap member for securing the footwork apparatus during the footwork activity.

In accordance with one or more aspects of the disclosed embodiment, the user selection includes a dance selection, a pace selection and a male/female selection.

In accordance with one or more aspects of the disclosed embodiment, the at least one motion sensor comprises an accelerometer.

In accordance with one or more aspects of the disclosed embodiment, the instruction routine includes an audio output and instructions for activating the array of lights for the footwork activity.

In accordance with one or more aspects of the disclosed embodiment, the evaluation routine includes instructions for comparing the instruction routine to the footwork activity.

In accordance with one or more aspects of the disclosed embodiment, the footwork activity includes dance steps.

In accordance with one or more aspects of the disclosed embodiment, the footwork apparatus includes a transmitter/receiver for two way communications.

In accordance with one or more aspects of the disclosed embodiment, a system for instructing and evaluating a footwork activity includes a footwork apparatus includes an upper member, a sole member connected to the upper member, an array of lights for instructing the direction of the footwork activity, at least one motion sensor, a speaker, a transmitter, a receiver, an instruction and evaluation module, an instruction routine, an evaluation routine and a power source, and a remote unit in wireless communication with the receiver of the footwork apparatus, wherein the remote unit transmits the instruction routine to the receiver of the footwork apparatus.

In accordance with one or more aspects of the disclosed embodiment, a remote unit includes at least one application and user interface.

In accordance with one or more aspects of the disclosed embodiment, the at least one application includes a dance instructing shoe, move n' groove, shop, and side games applications.

In accordance with one or more aspects of the disclosed embodiment, the dance instructing shoe application includes a what's new, most popular, learn/dance on screen solo, genre and my songs sub-application.

In accordance with one or more aspects of the disclosed embodiment, the move n' groove application includes a song list, side games, dance quick play, careers and shop sub-application.

In accordance with one or more aspects of the disclosed embodiment, the shop application includes a what's new, most popular, free songs of the day, browse and search by genre, artist, or song sub-application.

In accordance with one or more aspects of the disclosed embodiment, the side games application includes a hopscotch, balance, hacky sack and free style dance sub-application.

In accordance with one or more aspects of the disclosed embodiment, the wireless communications includes Wi-Fi and Bluetooth.

In accordance with one or more aspects of the disclosed embodiment, the remote unit includes at least one camera for recording the footwork activity.

In accordance with one or more aspects of the disclosed embodiment, the transmitter of the footwork apparatus transmits a result of the evaluation routine to the receiver of the remote unit.

In accordance with one or more aspects of the disclosed embodiment, a system for instructing and evaluating a footwork activity includes a remote database in wireless communications with the remote unit, wherein the remote database transmits the instruction routine to the remote unit.

In accordance with one or more aspects of the disclosed embodiment, the remote unit browses a list of available instruction routines located on the remote database and selects one or more instruction routines to be transmitted to the remote unit.

In accordance with one or more aspects of the disclosed embodiment, the remote unit searches a list of available instruction routines located on the remote database by genre, artist or song and selects one or more instruction routines to be transmitted to the remote unit.

In accordance with one or more aspects of the disclosed embodiment, the instruction routine comprises an audio output and instructions for activating the array of lights for the footwork activity.

In accordance with one or more aspects of the disclosed embodiment, the instruction routine includes a dance song.

In accordance with one or more aspects of the disclosed embodiment, the instruction routine includes a game.

In accordance with one or more aspects of the disclosed embodiment, the remote unit requests an instruction routine progress report located on the remote database to be transmitted to the remote unit.

In accordance with one or more aspects of the disclosed embodiment, a system for instructing and evaluating a footwork activity includes a plurality of remote units in wireless communications with the remote database and at least one social media site, wherein the remote unit may request at least one of the plurality of remote units through the at least one social media site to transmit a competitive instruction routines from the remote database to the at least one of the plurality of remote units.

In accordance with one or more aspects of the disclosed embodiment, the remote unit and the at least one of the plurality of remote units request an instruction routine progress report located on the remote database comparing a results of the competitive instruction routines.

What is claimed is:

1. A footwork apparatus for instructing and evaluating footwork activity, comprising:

an upper member and a sole member connected to the upper member;

an array of lights for instructing the direction of the footwork activity;

at least one motion sensor for determining the direction of the footwork activity;

a speaker for providing an audio output;

a receiver for receiving a user communication input;

at least one selector for providing a user selection input;

an instruction and evaluation module comprising a processor, memory and execution code configured to communicate with the array of lights, the at least one motion sensor, the speaker, the receiver and the at least one selector; and a power source for powering the instruction and evaluation module, the array of lights, the at least one sensor, the speaker, the receiver and the at least one selector.

2. The footwork apparatus of claim 1, further comprising a transmitter for transmitting an instruction and evaluation module communication output.

3. The footwork apparatus of claim 1, wherein the array of lights comprise arrow shaped lights embedded in the top of upper member.

4. The footwork apparatus of claim 1, wherein the array of lights comprise LED lights embedded in the side of the upper member.

5. The footwork apparatus of claim 1, further comprising a magnet embedded in the front of the upper member for connecting the article of footwork to a second article of footwork.

6. The footwork apparatus of claim 1, wherein the instruction and evaluation module is embedded in the sole member.

7. The footwork apparatus of claim 1, wherein the instruction and evaluation module is embedded in the upper member.

8. The footwork apparatus of claim 1, wherein the instruction and evaluation module comprise an instruction routine and an evaluation routine.

9. The footwork apparatus of claim 1, further comprising a score indicator indicating a result of the evaluation routine.

10. The footwork apparatus of claim 9, wherein the score indicator comprises a set of lights or a liquid crystal display.

11. The footwork apparatus of claim 1, further comprising a volume control for adjusting the intensity of the audio output.

12. The footwork apparatus of claim 1, further comprising a heel support member connected to the sole member.

13. The footwork apparatus of claim 12, further comprising a strap member for securing the footwork apparatus during the footwork activity.

14. The footwork apparatus of claim 1, wherein the user selection comprise a dance selection, a pace selection and a male/female selection.

15. The footwork apparatus of claim 1, wherein the at least one motion sensor comprises an accelerometer.

16. The footwork apparatus of claim 1, wherein the instruction routine comprises an audio output and instructions for activating the array of lights for the footwork activity.

17. The footwork apparatus of claim 1, wherein the evaluation routine comprises instructions for comparing the instruction routine to the footwork activity.

18. The footwork apparatus of claim 1, wherein the footwork activity comprises dance steps.

19. The footwork apparatus of claim 1, further comprising a transmitter/receiver for two way communications.

20. A system for instructing and evaluating a footwork activity, the system comprising:

a footwork apparatus including an upper member, a sole member connected to the upper member, an array of lights for instructing the direction of the footwork activity, at least one motion sensor, a speaker, a transmitter, a receiver, an instruction and evaluation module, an instruction routine, an evaluation routine and a power source; and a remote unit in wireless communication with the receiver of the footwork apparatus, wherein the remote unit transmits the instruction routine to the receiver of the footwork apparatus.

21. The system of claim 20, wherein the remote unit further comprising at least one application and user interface.

22. The system of claim 21, wherein the at least one application comprises a dance instructing shoe, move n' groove, shop, and side games applications.

23. The system of claim 22, wherein the dance instructing shoe application comprises a what's new, most popular, learn/dance on screen solo, genre and my songs sub-application.

24. The system of claim 22, wherein the move n' groove application comprises a song list, side games, dance quick play, careers and shop sub-application.

25. The system of claim 22, wherein the shop application comprises a what's new, most popular, free songs of the day, browse and search by genre, artist, or song sub-application.

26. The system of claim 22, wherein the side games application comprises a hopscotch, balance, hacky sack and free style dance sub-application.

27. The system of claim 20, wherein the wireless communications comprises Wi-Fi and Bluetooth.

28. The system of claim 20, wherein the remote unit further comprising at least one camera for recording the footwork activity.

29. The system of claim 21, wherein the transmitter of the footwork apparatus transmits a result of the evaluation routine to the receiver of the remote unit.

30. The system of claim 21, further comprising a remote database in wireless communications with the remote unit, wherein the remote database transmits the instruction routine to the remote unit.

31. The system of claim 30, wherein the remote unit browses a list of available instruction routines located on the remote database and selects one or more instruction routines to be transmitted to the remote unit.

32. The system of claim 30, wherein the remote unit searches a list of available instruction routines located on the remote database by genre, artist or song and selects one or more instruction routines to be transmitted to the remote unit.

33. The system of claim 21, wherein the instruction routine comprises an audio output and instructions for activating the array of lights for the footwork activity.

34. The system of claim 21, wherein the instruction routine comprises a dance song.

35. The system of claim 21, wherein the instruction routine comprises a game.

36. The system of claim 30, wherein the remote unit requests an instruction routine progress report located on the remote database to be transmitted to the remote unit.

37. The system of claim 30, further comprising a plurality of remote units in wireless communications with the remote database and at least one social media site, wherein the remote unit may request at least one of the plurality of remote units through the at least one social media site to transmit a competitive instruction routines from the remote database to the at least one of the plurality of remote units.

38. The system of claim 37, wherein the remote unit and the at least one of the plurality of remote units request an instruction routine progress report located on the remote database comparing a results of the competitive instruction routines.

* * * * *